United States Patent [19]

Roberts et al.

[11] Patent Number: 4,607,440

[45] Date of Patent: Aug. 26, 1986

[54] OUTSOLE FOR ATHLETIC SHOE

[75] Inventors: Leslie E. Roberts, Haverhill; Sumner F. Davis, Methuen, both of Mass.

[73] Assignee: Converse Inc., Wilmington, Mass.

[21] Appl. No.: 570,172

[22] Filed: Jan. 12, 1984

[51] Int. Cl.[4] ..... A43B 5/00; A43B 13/00

[52] U.S. Cl. ..... 36/114; 36/59 C

[58] Field of Search ..... 36/103, 114, 129, 128, 36/30 R, 59 C, 59 R, 83, 25

[56] References Cited

U.S. PATENT DOCUMENTS

| | | | |
|---|---|---|---|
| 3,082,549 | 3/1963 | Dolceamore | 36/89 X |
| 4,372,058 | 2/1983 | Stubblefield | 36/59 C X |
| 4,402,145 | 9/1983 | Dassler | 36/129 X |
| 4,404,759 | 9/1983 | Dassler | 36/129 |
| 4,481,727 | 11/1984 | Stubblefield | 36/83 |

FOREIGN PATENT DOCUMENTS

| | | | |
|---|---|---|---|
| 256664 | 12/1966 | Austria | 36/59 C |
| 871261 | 2/1953 | Fed. Rep. of Germany | 36/59 C |

*Primary Examiner*—Werner H. Schroeder
*Assistant Examiner*—T. Graveline
*Attorney, Agent, or Firm*—Bromberg, Sunstein & McGregor

[57] ABSTRACT

An outsole for an athletic shoe includes a central traction portion having a plurality of transverse grooves, each groove including forward facing and rearward facing groove walls. Forward facing and rearward facing traction elements are located on the respective groove walls. In a preferred embodiment the traction elements are each tapered along a central axis. In a further embodiment a peripheral region of the sole includes a second plurality of larger traction elements. The larger elements each taper along a central axis sloping outward from the central portion. The central portion is raised with respect to the peripheral region, so that its traction elements may contact the ground despite the greater height of the larger traction elements of the peripheral region.

5 Claims, 10 Drawing Figures

OUTSOLE FOR ATHLETIC SHOE

DESCRIPTION

1. Technical Field

The present invention is an outsole for an athletic shoe, and more particularly an outsole having a traction pattern adaptable to both field sports, indoor sports, and artificial turf.

2. Background of the Invention

It has long been the practice to equip sneakers, running shoes and more specialized athletic shoes with a variety of protruding ridges or cleats on the bottom of the sole so as to enhance traction. One approach, that of using a series of transverse grooves or ridges, has seen wide use in the field of rubber outsoles for shoes generally, and for sneakers in particular, in applications where such a grooved or bumpy surface serves to enhance traction against smooth wet surfaces such as asphalt walks, or tile floors. Where the ground surface is one which itself offers no security against slipping, as for instance a muddy outdoor playing field, a second approach, using larger protrusions, such as spikes or cleats as the preferred traction element, is preferred. By digging into the ground, a spike or cleat element assures gripping of the ground to a greater depth, and diminishes the likelihood of slipping. The cleats of such conventional specialty shoes as football shoes, baseball shoes and the like have traditionally been few in number, so as not to pick up and hold a matted layer of mud; typically such shoes have fewer than ten cleats, and these are arranged at the normal impact points of the foot and away from normal flex lines of the sole. Furthermore, in recent years, a variety of outsoles have appeared on diverse shoes incorporating features of both of the above types, in which a larger number of relatively large protrusion are arranged in rows on the base of the outsole. Such hybrid soles are for general use in field sports, or as leisure footwear; they offer traction properties somewhat adapted to both uses.

Each of the above designs however involves some tradeoff in terms of stability, comfort and utility. Thus, the use of large cleats renders a shoe unsuitable for walking on hard surfaces, and particularly irregular hard surfaces such as rocky outdoor surfaces. The use of a transverse groove pattern, while of general utility for indoor or finished outdoor surfaces, provides no noticeable benefits on grassy fields or muddy surfaces, and may tend to accumulate mud between the grooves making it unsuitable for indoor-outdoor wear. A hybrid shoe having a large number of medium sized cleats arranged in rows may also be somewhat unstable on irregular hard surfaces, and may tend to pick up mud, rendering it unsuitable as a general purpose indoor-outdoor shoe. Each of the prior art outsoles utilizing protruding spikes or cleats also tends to detract from the comfort of the shoe and to provide a somewhat rigid shoe.

BRIEF DESCRIPTION OF THE INVENTION

The present outsole overcomes disadvantages of the prior art by providing an outsole with traction elements sloping toward a plurality of preferred directions of motion. The sloping traction elements taper to a point which contacts the ground obliquely, and displaces vertically under the weight of the wearer, providing a more comfortable and secure gripping action. In a preferred embodiment the outsole contains a plurality of transverse grooves, each groove having a forward facing and a rearward facing wall. Forward facing and rearward facing traction elements, located on respective forward and rearward facing walls, project therefrom along oblique, generally forward and rearward facing, axes so as to engage the ground and provide preferential gripping action in those directions in use. In a further embodiment of the invention a plurality of larger protruding nubs are arranged in a band around the periphery of the shoe. The nubs are each symmetrical about a central axis, and taper as they rise from the shoe sole. The central axis of each nub is slanted outwardly from the central portion of the shoe, so as to provide a wider net ground contacting surface, and also to assure deeper penetration by the nub when the wearer's foot strikes the ground at such an angle as to engage that particular nub. These and other features of the invention will be understood with reference to the drawings.

BRIEF DESCRIPTION OF THE DRAWINGS

FIG. 10 shows the raised central portion and profile of a peripheral nub in the toe region of the outsole of FIG. 7.

DETAILED DESCRIPTION OF THE INVENTION

Figure 1:
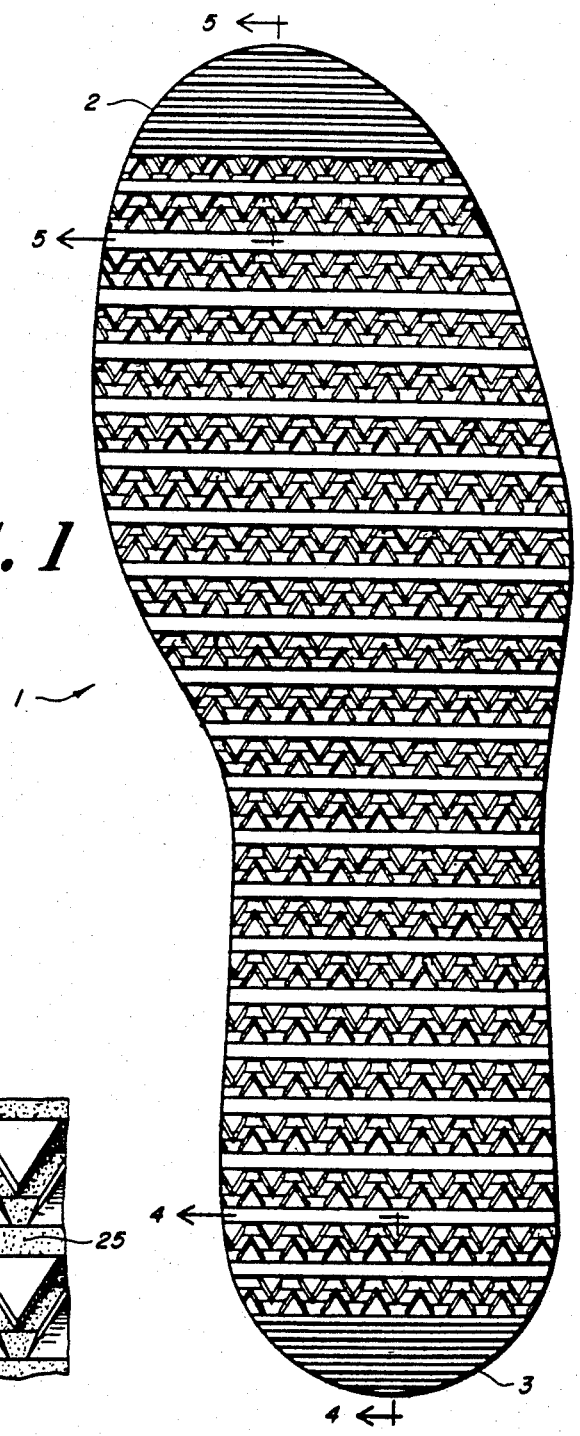
FIG. 1 shows one embodiment of an outsole according to the present invention.

FIG. 1 shows an outsole according to a preferred embodiment of the present invention, in which a plurality of obliquely facing traction elements are provided, oriented along a preferred direction of motion. The outsole 1 has a toe portion 2, a central traction portion 6, and a heel portion 3. The traction patterns at the toe portion 2 and the heel portion 3 are of conventional design, and form no part of the present invention. The pattern of central traction portion 6 may, of course, be continued into the toe and heel portions; however these areas contribute little to the traction of the shoe, and the patterns in toe and heel portions 2 and 3 are designed more for rolling or scuffing engagement with the ground, and designed in such manner to permit a flexible and secure bonding of the outsole to the upper.

Central traction portion 6 of the outsole 1 includes a plurality of parallel transverse rows of traction elements discussed in greater detail with regard to FIG. 2 below. The sets of traction elements are separated by plateau portions 25, which are parallel, generally flat, and substantially co-planar portions defining a ground contacting surface of the outsole.

Figure 2:
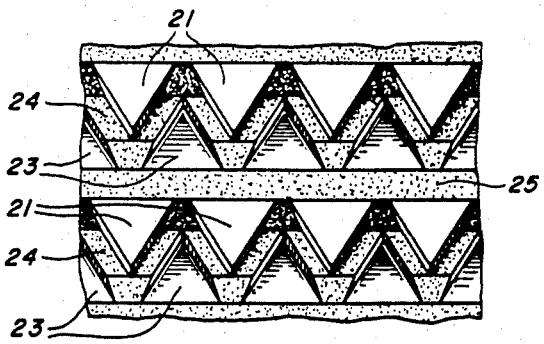
FIG. 2 shows details of the traction pattern of the outsole of FIG. 1.

Turning now to FIG. 2 there is shown an enlarged detail of two transverse grooves and the associated traction elements of the outsole 1. As shown, the traction pattern includes a plurality of grooves located between the plateaus 25. Each groove includes a forward facing wall 23 and a rearward facing wall 21. Preferably, the walls slope generally obliquely downward into the body of the sole so as to form a groove therein. Located on wall 23 are a plurality of traction elements 33; corresponding traction elements 31 are located on wall 21. As shown, the traction elements 31 and 33 taper as they rise from their respective walls and each have a central axis of symmetry which points in a generally backward (respectively forward) direction. The traction elements are alternating along the groove, and define an interstitial zig-zag channel 24 therebetween. Because the grooves formed by walls 21, 23 are transverse, they flex under normal running or walking motion, causing channels 24 to open up and eject particles of mud which may have accumulated therein. Furthermore, because the vertically exerted weight of the wearer is not directly along the axis of each traction element, the axis bends in use, providing a certain resilience and added comfort. The relatively small traction elements 31, 33 have been found to provide excellent traction on artificial turf, without causing snagging, a problem of conventional large cleats.

Figure 3:
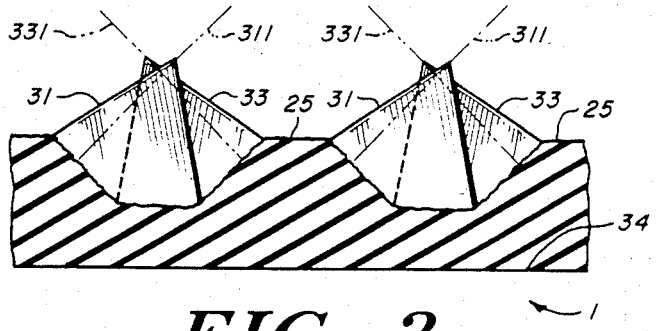
FIG. 3 shows a cross sectional view of the traction pattern.

Turning now to FIG. 3 there is shown in lateral cross section an enlarged detail of the two grooves of FIG. 2. The grooves are defined by respective forward facing groove walls 21 and rearward facing walls 23, with rearward facing teeth 31 and forward facing teeth 33 located thereon. The adjacent grooves are separated by plateaus 25 which define a generally flat ground contacting face of the outsole. As shown, rearward facing tooth 31 has a central axis 311 which rises from face 21 and is located centrally of the traction element 31. Similarly, forward facing traction element 33 has a central axis 331 which rises from face 23. When a runner is running with a forward or rearward velocity, the projections 33, 31 will tend to engage the ground with their point first, thereby enhancing traction; on the other hand when the wearer is stationary, the body's weight will be directed directly downward, thereby bending the traction elements 31, 33 along their respective axes 311, 331, thus providing a cushioning effect. As shown, outsole 1 is made of a relatively thin rubber, with the distance from the bottom of the groove to the opposing edge 34 of the sole being approximately of the same order of magnitude as the size of the projecting traction elements 31, 33.

Figure 4:
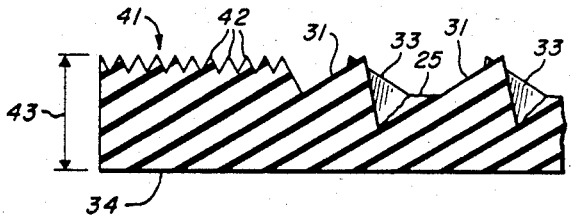
FIG. 4 shows a section of the heel portion of the outsole of FIG. 1.

Turning now to FIG. 4 there is shown a section along line 4—4 of the outsole of FIG. 1 in the heel area thereof. Sets of traction elements 31, 33 separated by plateaus 25 are shown in side view. Also shown is the conventional traction pattern 41 in the heel area, including a plurality of parallel ridges 42 having a triangular profile. The distance from the heel traction pattern 41 to the opposing edge 34 of the outsole is chosen to provide good wearing property, and is preferably of a substantial thickness 43 as shown.

Figure 5:
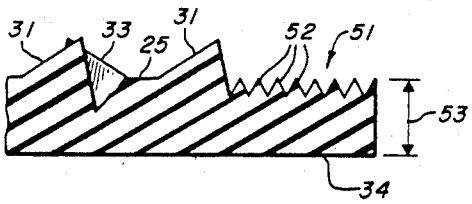
FIG. 5 shows a section of the toe portion of the outsole of FIG. 1.

Turning now to FIG. 5 there is shown the corresponding section along the line 5—5 of the toe portion of the outsole of FIG. 1. The toe portion 51 includes traction elements 52 of a conventional kind which, as shown, are of the same profile as the elements 42 discussed above. The toe thickness 53 may be less than that of the heel thickness 43, because while subject to scuffing, the toe generally does not receive direct impact or weight, and thus is not subject to extreme conditions of wear.

Figure 6:
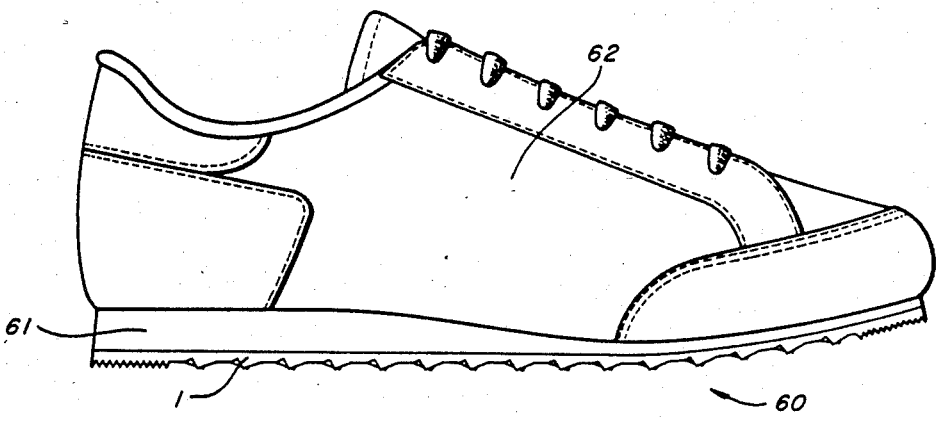
FIG. 6 shows a perspective view of an athletic shoe having the outsole of FIG. 1.

Turning now to FIG. 6, there is shown a perspective view of an athletic shoe utilizing the outsole of FIG. 1 of the present invention. As shown, the outsole 1 is a relatively thin layer on the ground contacting portion of the shoe, and curves upward toward the toe area therof. This is the preferred method of embodiment for the outsole, inasmuchas the detailed traction pattern is best formed by a process in which the outsole must be "peeled" from a mold and is therefore preferably of a relatively thin and flexible character. The material from which outsole 1 is formed however must be capable of good wear qualities, and is thus preferably a rubber reinforced with hard particulate matter to provide good wearing ability. Midsole layer 61 may be of any conventional material, such as an EVA foam. While shown as a single contoured piece, midsole layer 61 may be formed of a wedge and a sheet, several sheets, one sheet of uniform thickness, or any other conventional construction. Also shown is an upper portion 62, of conventional construction. While shown as a low cut shoe, the upper may be of any type, such as a high top, or basketball shoe.

Figure 7:
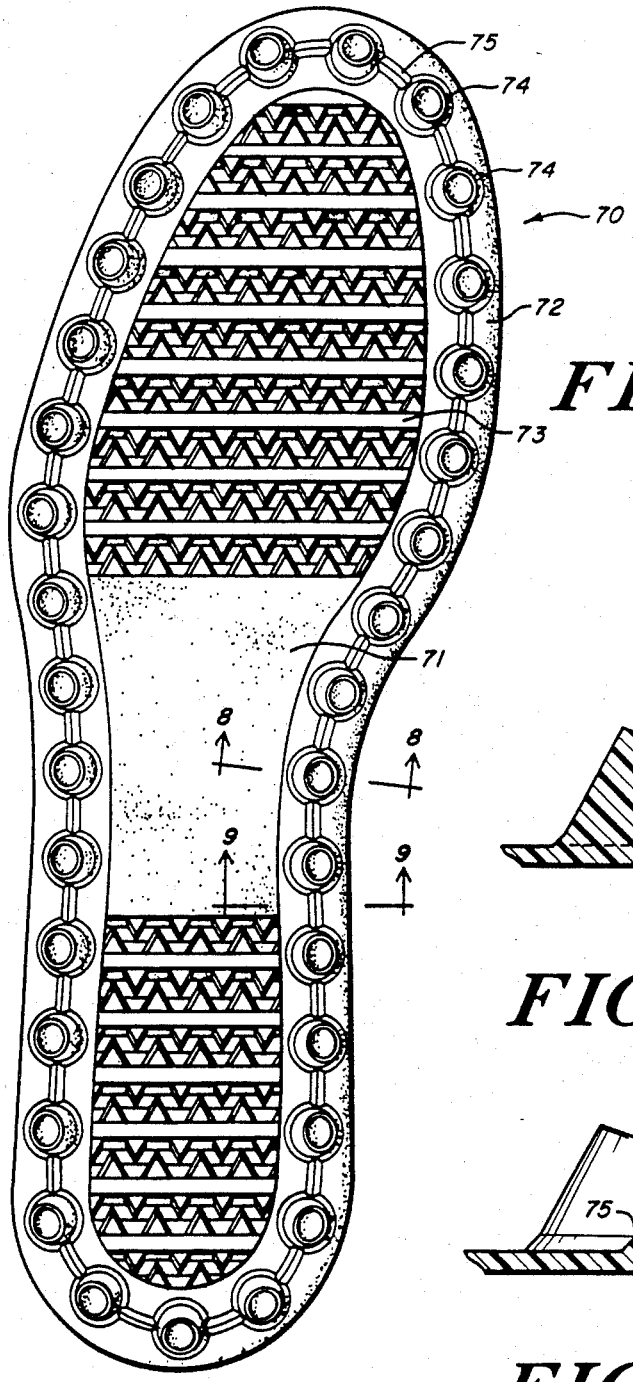
FIG. 7 shows another embodiment of the present invention having a perimeter of outward sloping traction nubs.

Turning now to FIG. 7 there is shown a further embodiment of the outsole according to the present invention. In this embodiment, outsole 70 has a central traction portion 73, an arch portion 71, and a peripheral region 72. The central traction portion 73 is preferably the pattern of FIG. 1, described above. Located in peripheral region 72 are a number of separate larger nubs 74 spaced in a narrow band around the periphery of the shoe. Connecting each pair of adjacent nubs 74 is a perimeter ridge 75. Preferably, each of the nubs 74, rather than facing straight down from the outsole 70, slopes gently outward. In this manner, when a nub sees primary use, for instance as when a runner is banking in a turn, the nub will tend to point straight downward into the ground, because the runner's foot will actually be slanted at an angle corresponding to the obliqueness of the projecting nub. In addition, the slope of the nubs provides a smooth rolling lateral motion, preventing abrupt binding and ankle injury. This feature is better illustrated with reference to FIG. 8 below.

Figure 8:
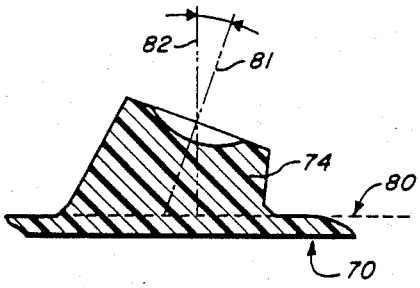
FIG. 8 shows a section through an oblique perimeter nub of the outsole of FIG. 7.

In FIG. 8 there is shown a cross section along the line 8—8 of FIG. 7 through a nub 74 of the outsole of the present invention. As shown, outsole 70 includes a substantially flat sheet which defines plane 80. For purposes of illustration, axis 82 is shown, perpendicular to the plane 80 defined by the outsole. Nub 74 is a tapered projection rising from plane 80 along oblique axis 81, which as shown is tilted outward from the central portion of the shoe forming an angle to axis 81. In this manner, the ground contacting portion of nub 80 is located further outward from the central portion of the shoe than the base portion thereof, and thus provides a wider ground contacting portion than would a set of conventional cleats, for enhanced stability.

Figure 9:
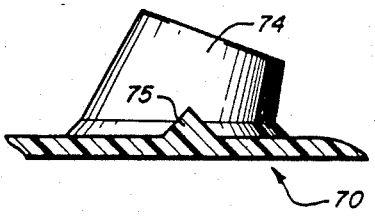
FIG. 9 shows a section through the perimeter ridge of the outsole of FIG. 7.

Turning now to FIG. 9, there is shown a section along line 9—9 of the outsole of FIG. 7, through the perimeter ridge 75. Ridge 75 provides a continuous connecting member connecting all the nubs 74 in the perimeter region. As such, it both provides a degree of structural support, and serves as a breaker for accumulated mud which may stick to the outsole. When the nubs 74 are sunk into dirt, ridge 75 also provides a traction effect against lateral slipping. It will be appreciated that the embodiment shown in FIG. 7 provides two patterns of traction elements of different sizes, each pattern including elements having an axis for providing traction in a preferred direction of motion. The central portion has forward facing and rearward facing traction elements for normal motion. The peripheral portion has larger outwardly slanting nubs for gripping under diverse turning motions. It is further envisaged that where the outsole is intended for use on a relatively flat and unyielding surface, such as artificial turf, the central traction pattern 73 should be raised slightly with respect to the plane 80 defining the base of the peripheral traction pattern of region 72. In this manner, under normal motion, both traction patterns will dependably engage the ground surface as required, while still permitting the peripheral pattern to perform its deeper traction functions when the foot is obliquely oriented with respect to the ground.

Turning to FIG. 10 there is shown a section in the toe region of the outsole of FIG. 7, in which the central traction portion 73 is shown somewhat elevated with respect to the peripheral nub 74, so that the central portion can grip the ground despite the larger dimensions of the peripheral nubs. As shown, the plateaus 25 are at a height h which is a fraction of the height of nub 74.

While the invention has been described with respect to particular embodiments thereof it will be appreciated that it may be embodied in a variety of forms. Accordingly the invention is limited only by the following claims.

What is claimed is:

1. An outsole for an athletic shoe, comprising:

(a) a base surface in a first plane for contacting the ground and having a longitudinal axis;

(b) a plurality of parallel, V-shaped grooves located in the base surface and transverse to the longitudinal axis, each groove having a pair of opposing walls oblique to the base surface; and (c) a plurality of traction elements, closely spaced without making contact one with another at any point, and each having a tip, such traction elements located on the walls and projecting outward therefrom, wherein the traction elements are alternately arranged on the opposing walls so as to form a tightly woven, continuous zig-zag channel therebetween, each traction element projecting out beyond the first plane at an oblique angle thereto, the tips of such elements forming a resilient matrix in a second plane so disposed as to make contact with the ground before contact therewith of the base surface when such outsole is in use.

2. An outsole according to claim 1, wherein each traction element is formed so as to have a central axis of approximate symmetry, and is tapered along that central axis.

3. An outsole according to claim 2, wherein each traction element is of a generally pyramidal shape.

4. An outsole according to claim 2, wherein each traction element is substantially tetrahedral, including one tetrahedral face attached to the groove wall and bordering on the base surface, and three exposed tetrahedral faces, including a first exposed face extending out from the base surface to the second plane, and second and third faces extending from the groove wall to the second plane.

5. An outsole according to claim 2, wherein the base surface includes a series of substantially straight bands disposed parallel to and in alternation with the grooves.

* * * * *